United States Patent [19]

Anderson et al.

[11] 4,260,992

[45] Apr. 7, 1981

[54] RADIO NAVIGATION ANTENNA SYSTEM FOR AIRCRAFT

[75] Inventors: Mardis V. Anderson, Richardson; Theodore A. Dumas, Dallas, both of Tex.

[73] Assignee: Rockwell International Corporation, El Segundo, Calif.

[21] Appl. No.: 101,049

[22] Filed: Dec. 6, 1979

[51] Int. Cl.[3] ..... H01Q 3/12

[52] U.S. Cl. ..... 343/761; 343/106 R

[58] Field of Search ..... 343/106 R, 761, 766, 343/834, 837, 838, 846

[56] References Cited

U.S. PATENT DOCUMENTS

| | | | |
|---|---|---|---|
| 2,889,552 | 6/1959 | Thomas et al. | 343/761 |
| 3,054,107 | 9/1962 | Engel et al. | 343/761 |
| 3,541,562 | 11/1970 | Dodington et al. | 343/761 |
| 3,790,943 | 2/1974 | Pickles et al. | 343/106 R |
| 4,071,847 | 1/1978 | Pickles | 343/761 |

*Primary Examiner*—David K. Moore

*Attorney, Agent, or Firm*—V. Lawrence Sewell; Howard R. Greenberg; H. Fredrick Hamann

[57] ABSTRACT

A radio navigation antenna system suitable for use in an aircraft is disclosed. The fed element of the system is stationary, being at one end of a coaxial conductor which extends through a hollow shaft of a motor. Mounted around the hollow shaft is a ground plane disc capacitively coupled to the outer sleeve of the coaxial conductor, thereby avoiding the use of brushes in the system. A cylindrical dielectric antenna support is mounted on the ground plane disc around the fed element. A T-shaped reflector is formed by a conductive layer on the cylindrical surface of the antenna support.

5 Claims, 2 Drawing Figures

RADIO NAVIGATION ANTENNA SYSTEM FOR AIRCRAFT

BACKGROUND OF THE INVENTION

This invention relates to radio navigation antenna systems and particularly to an antenna system suitable for use on an aircraft.

In current practice, radio navigation antenna systems such as TACAN systems are ground stations. However, an airborne system would have considerable utility. For example, it could be used to guide aircraft to a flying tanker for refueling. Efforts to provide such an airborne antenna system have been attempted, but they have not been successful until the present invention.

SUMMARY OF THE INVENTION

In accordance with the present invention, there is provided an antenna system in which a stationary fed element is at the end of a coaxial conductor that extends through the hollow shaft of a motor. A ground plane disc is attached to the motor shaft for rotation at the base of the fed element. A cylindrical reflector support of a low mass, high dielectric constant material is mounted on the ground plane disc to rotate around the fed element. The support holds a T-shaped reflector formed by a conductive layer on the cylindrical surface of the support. The ground plane disc is coupled through adjacent structures to the outer sleeve of the coaxial conductor. The coupling includes capacitive coupling between the coaxial conductor sleeve and the wall of the hollow motor shaft.

The use of a stationary fed element and capacitive coupling to the rotating elements of the antenna system avoids the use of brushes, thereby avoiding electrical noise and reliability problems associated with brushes. The design conceived for the rotating ground plane and reflector assembly achieve a low mass and moment of inertia which permit the use of a small motor, and contribute to a lightweight system suitable for airborne use. Several attributes of the design make the reflector of the antenna system appear electrically to project higher above the ground plane disc than it actually does mechanically, thus providing a low profile, compact system further suitable for use on an aircraft.

DESCRIPTION OF A PREFERRED EMBODIMENT

Figure 1:
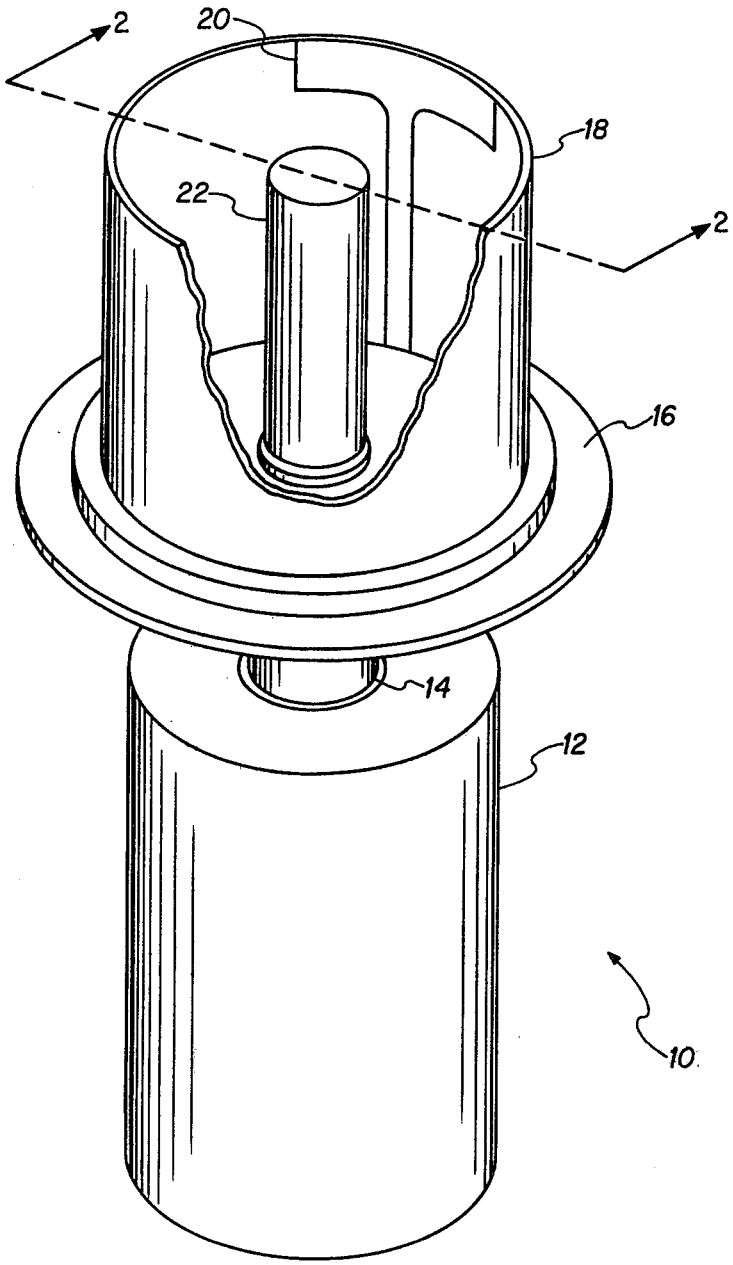
FIG. 1 is a perspective view of the motor, fed element, ground plane disc and reflector assembly (broken away) of an antenna system according to the invention.
Figure 2:
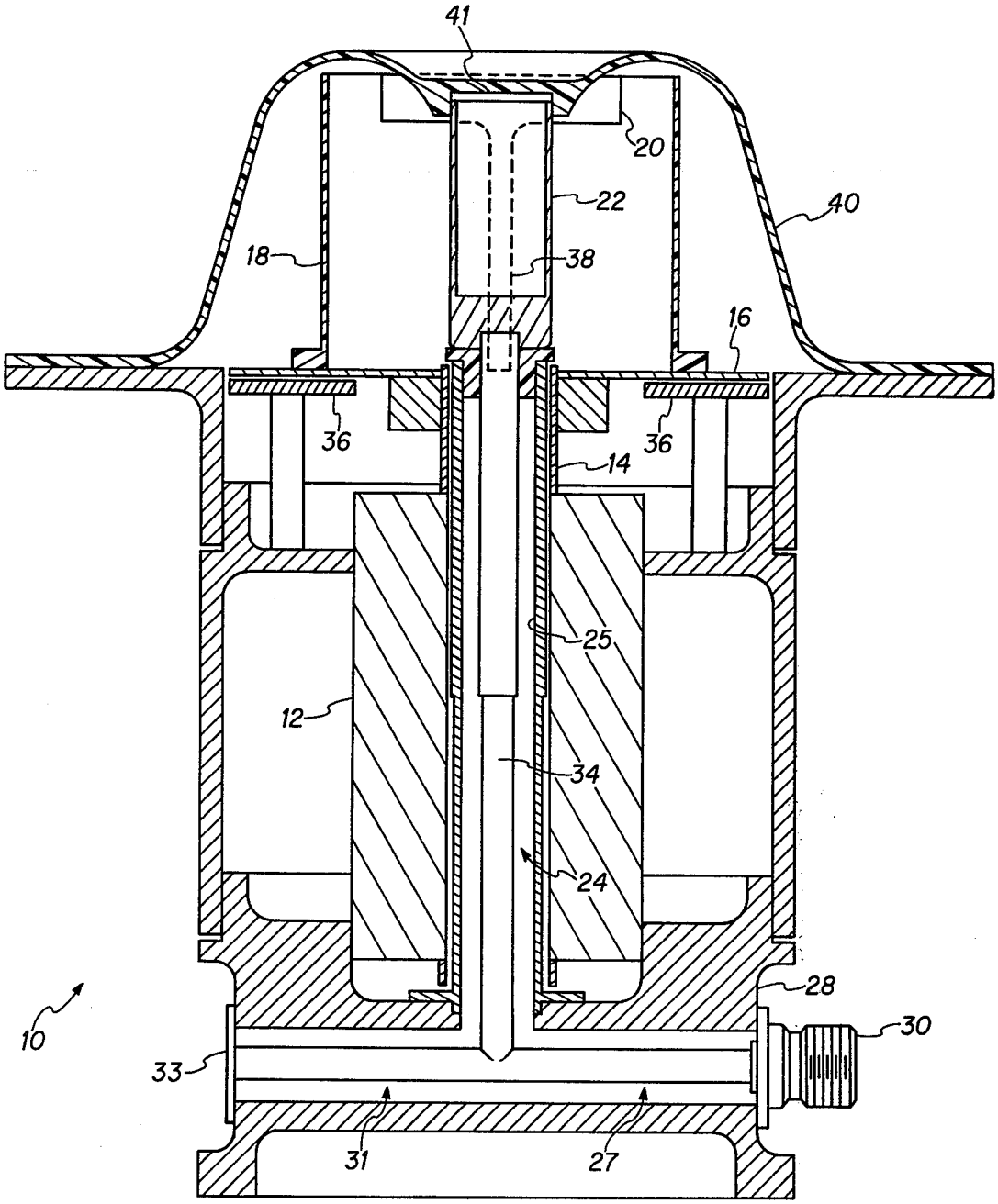
FIG. 2 is a sectional view of an antenna system according to the invention, including the elements of FIG. 1 viewed at line 2—2.

FIGS. 1 and 2 show in detail an antenna system according to the invention, indicated generally by the reference numeral 10. Major portions of the functional elements of the system are shown in FIG. 1. A motor 12 turns a shaft 14 which rotates a ground plane disc 16 mounted on the shaft. A cylindrical reflector support 18 attached to disc 16 rotates with it. On the cylindrical surface of reflector support 18 is a T-shaped reflector 20.

Radiation from a stationary fed element 22 is reflected from ground plane disc 16 and reflector 20. As a result, the direction of the main strength of radiation from the antenna system 10 will be going away from reflector 20 and past fed element 22. Preferably motor 12 should be capable of turning the rotating assembly at a constant angular speed, causing the radiation pattern to rotate. In addition, motor 12 should preferably be a stepping motor which when combined with electronic means known in the art makes it possible to electronically command the rotation of reflector 20 to a selected angle with respect to aircraft heading and hold that stationary angular position.

The sectional view of FIG. 2 shows important structural details of antenna system 10. Shaft 14 of motor 12 is hollow and of an electrically conductive material. Running through the hollow shaft 14 is a coaxial conductor indicated generally by the reference numeral 24. The portion of the coaxial conductor passing through the motor shaft is a continuation of a portion 27 formed in housing 28. A connector 30 forms the input of coaxial conductor 24. A quarter wavelength stub 31 interconnects with conductor 24 to tune the antenna system. The stub is shorted to ground at the end 33 thereof to present the correct impedance and to provide a DC path to ground from center conductor 34 in case of lightning.

The outer conducting sleeve 25 of the coaxial conductor 24 is spaced sufficiently close to the wall of motor shaft 14 so that the shaft and the conductor sleeve are capacitively coupled at the frequencies for which the antenna system 10 is employed, for example, 962–1213 MHz. The motor shaft 14 in its attachment to ground plane disc 16 makes electrical connection therewith so that there is effectively capacitive coupling between coaxial conductor sleeve 25 and conductive ground plane disc 16.

Also capacitively coupled to ground plane disc 16 are conductive planar surfaces 36. These surfaces are connected by various metallic mechanical connections to housing 28 and thereby electrically connected to outer sleeve 25 of coaxial conductor 24. Thus, coaxial conductor sleeve 25 is capacitively coupled through several means to ground plane disc 16.

Fed element 22 is a cylindrical structure extending from one end of the center conductor of coaxial conductor 24, and having the same cylindrical axis as the center conductor.

Reflector support 18 is a cylindrical structure formed of a lightweight high dielectric constant material such as fiberglass. The walls of support 18 should be relatively thin in order to provide a low mass and moment of inertia. For example, a suitable thickness for fiberglass walls of support 18 is 1/32 inch.

Reflector 20 is of the T-shape shown in FIGS. 1 and 2, with arms parallel to disc 16 and the center leg 38 thereof parallel to fed element 22. The reflector 20 can be formed for example of 0.020 inch thick sheet aluminum and attached with adhesive to support 18 so as to conform to its inner cylindrical surface. The bottom of the center leg 38 is electrically connected to disc 16, as by a rivet.

For the frequency range 962–1213 megahertz, for example, suitable dimensions for reflector support 18 are a 3 inch diameter and 2½ inch height. At this size and with the reflector 20 as described above and in the drawings, the total weight of the reflector support and reflector 20 is approximately 1.5 ounce. This permits a small stepping motor to rotate the reflector assembly at a 900 rpm rate suitable for operation of the antenna system 10.

The reflector 20 and its support 18 provide the advantage that the reflector performs electrically as though it were taller above the ground plane disc 16 than it actually is. This advantage results from several factors: the combination of a conductive reflector on a dielectric support, the particular shape of the reflector 20 and the mounting of the reflector 20 against the surface of the support rather than protruding from it. The antenna system as described generates a cardiod azimuth pattern and an elevation pattern with useful energy predominantly from the horizon to 45 degrees above.

Covering the reflector support 18, fed element 22 and ground plane disc 16 is a radome 40 which can also be of fiberglass. Radome 40 has a recessed portion 41 in the inner surface thereof to support the free end of fed element 22 opposite coaxial conductor 25.

The antenna system 10 offers a number of advantages. The use of the stationary fed element and capacitive coupling to the rotating ground plane and reflector assembly results in a brushless operation, thereby eliminating contact noise and improving reliability. The small, low mass assembly of the reflector support and reflector can be used with a small motor to provide an overall antenna system highly suitable for use on an aircraft. As described above, attributes of the reflector design permit the reflector 20 to have an apparent height above the ground plane disc 16 which is greater than its actual mechanical height. As a result, the antenna system may have a lower profile.

We claim:

1. An antenna comprising:

a motor having an electrically conductive hollow shaft;

a coaxial conductor with the same axis as said hollow shaft and passing therethrough, with an outer conducting sleeve of the coaxial conductor sufficiently close to the wall of the shaft to permit effective capacitive coupling at the frequencies at which the antenna operates;

an elongated conductive fed element at an end of the coaxial conductor, extending from said center conductor along the axis thereof;

a planar conductive ground plane member attached to and electrically connected with said shaft and perpendicular thereto, at the end of the coaxial conductor, exposed over substantially the entire surface of the member to radiation from said fed element;

a cylindrical reflector support mounted on the ground plane member around the fed element and having the same axis as said center conductor, said support being formed of a high dielectric constant material;

a reflector on said support, formed as a conductive layer conforming to the cylindrical surface of the support; and a planar conductive surface electrically connected to the sleeve of said coaxial conductor and placed parallel to the ground plane member at the surface thereof opposite said reflector support and sufficiently close to said member to permit effective capacitive coupling therewith at the frequencies at which the antenna operates.

2. The antenna system of claim 1, wherein said reflector is T-shaped, with arms of the T extending parallel to the surface of the ground plane member and a center leg of the T being parallel to the axis of said center conductor and electrically connected to the disc.

3. The antenna system of claim 1, further including a quarter wavelength coaxial stub interconnecting with said coaxial conductor, the end of said stub having the center conductor thereof shorted to ground.

4. The antenna system of claim 1, wherein said motor is a stepping motor and wherein said system further includes means for actuating said motor so as to hold said shaft, disc and reflector in a selected stationary position.

5. An antenna system comprising:

a motor having an electrically conductive hollow shaft;

a coaxial conductor with the same axis as said hollow shaft and passing therethrough, said coaxial conductor comprising a center conductor and an outer conducting sleeve, with said sleeve sufficiently close to the wall of the shaft to permit effective capacitive coupling at the frequencies at which the antenna operates;

a cylindrical, conductive fed element at an end of the coaxial conductor extending from said center conductor along the axis thereof;

a conductive ground plane disc attached to and electrically connected with said shaft and perpendicular thereto, at the end of the coaxial conductor, exposed over substantially the entire surface of the disc to radiation from said fed element;

a low mass cylindrical reflector support mounted on said disc around the fed element and having the same axis as said fed element, said support being formed with thin walls of a high dielectric material;

a T-shaped reflector on said support, formed as a conductive layer conforming to the cylindrical surface of the support, with arms of the T extending parallel to the surface of said disc and a center leg of the T being parallel to said fed element and electrically connected to the disc, said leg being approximately the length of said fed element;

a planar conductive surface electrically connected to the outer sleeve of said coaxial conductor and placed parallel to said disc at the surface of the disc opposite said reflector support and sufficiently close to the disc to permit effective capacitive coupling therewith at the frequencies at which the antenna operates; and a dielectric radome covering said fed element, said support and said disc, and including a portion for supporting the end of the fed element opposite the end of said coaxial conductor.

* * * * *